United States Patent [19]

Hitchcock et al.

[11] 4,143,304

[45] Mar. 6, 1979

[54] POSITIVE STARTING AND OPERATING APPARATUS FOR HIGH-PRESSURE SODIUM LAMPS

[75] Inventors: William H. Hitchcock, Columbia Station; Archie R. Cornell, Avon Lake, both of Ohio; Joseph C. Engel, Monroeville, Pa.

[73] Assignee: Westinghouse Electric Corp., Pittsburgh, Pa.

[21] Appl. No.: 730,096

[22] Filed: Oct. 6, 1976

[51] Int. Cl.[2] ..... H05B 41/16

[52] U.S. Cl. ..... 315/276

[58] Field of Search ..... 315/258, 276

[56] References Cited

U.S. PATENT DOCUMENTS

| | | | |
|---|---|---|---|
| 3,475,651 | 10/1969 | Harding et al. | 315/276 X |
| 3,579,026 | 5/1971 | Paget | 315/258 X |
| 3,676,734 | 7/1972 | Shimizu et al. | 315/258 X |
| 3,917,976 | 11/1975 | Nuckolls | 315/258 |
| 3,931,543 | 1/1976 | Nuckolls | 315/258 X |
| 3,963,958 | 6/1976 | Nuckolls | 315/276 |
| 3,997,814 | 12/1976 | Toho | 315/258 X |

*Primary Examiner*—Peter A. Nelson

*Attorney, Agent, or Firm*—R. S. Lombard

[57] ABSTRACT

Lighting apparatus provides high-voltage pulses for starting high-pressure sodium discharge lamps and thereafter provides operating ballasting. The apparatus uses a voltage amplification circuit the output of which is applied across a ballast reactor which is connected thereto in autotransformer relationship. This provides a sufficiently high-voltage starting pulse, even when ballast reactors of low open circuit voltage are used, to initiate the operation of high-pressure sodium discharge lamps.

3 Claims, 3 Drawing Figures

POSITIVE STARTING AND OPERATING APPARATUS FOR HIGH-PRESSURE SODIUM LAMPS

BACKGROUND OF THE INVENTION

This invention relates to apparatus for starting and then operating high-pressure sodium discharge lamps and, more particularly, to such apparatus which provides high-voltage pulses to start such lamps even at relatively low-line voltage.

A number of discharge lamp lighting circuits have been developed in recent years and one such apparatus is described in copending application Ser. No. 540,185, filed on Jan. 10, 1975 by Joseph C. Engel and Gary F. Saletta, and owned by the present assignee. The apparatus described in this copending application provides for high-voltage pulses for starting a sodium discharge lamp by using the breakdown characteristics of a Zener diode to provide accurately timed starting pulses. The use of the Zener diode eliminates timing problems encountered when the breakdown characteristics of a glow lamp are used in somewhat similar fashion, as described in U.S. Pat. No. 3,917,976 issued Nov. 4, 1975 to Nuckolls and U.S. Pat. No. 3,963,958 issued June 5, 1976 to Nuckolls. The circuit described in the aforementioned copending application and the prior art described in the aforesaid Nuckolls' patent issued June 15, 1976, function satisfactorily in many applications, although difficulties are encountered when ballast reactors of low open circuit voltage are used. To compensate for this problem, a larger than desirable storage capacitor and a smaller charging resistor could be used which in turn creates a problem of diverting some of the lamp starting high-voltage pulse. The aforementioned Nuckolls' patent issued Nov. 4, 1975 used an R.F. choke in series with the charging resistor to offer a higher impedance to the generated high voltage pulse, thereby transferring more starting power to the lamp. This in turn increased the cost of the starting circuit.

SUMMARY OF THE INVENTION

There is provided a starting and operating apparatus for connection across an AC source for starting and then operating a high-pressure sodium discharge lamp. The apparatus comprises input terminals which are adapted (i.e., operable) to be connected across the AC source and output terminals which are adapted (i.e., operable) to have the discharge lamp connected thereacross and, when the AC source has a high impedance, a power-factor correcting capacitor, which also provides high frequency bypass, is connected across the input terminals. A ballast inductor has a tap intermediate the ends thereof which defines first and second winding portions, said first winding portion having a greater length than said second winding portion, and having a transformation ratio therebetween substantially greater than unity. The ballast inductor is connected at its ends in series between one of the input terminals and one of the output terminals, with the second winding portion connected to one of the output terminals. The other of the input terminals electrically connects to the other of the output terminals. A capacitive energy storage means and associated blocking diode means connects across the second winding portion of the ballast inductor and also in circuit with the other output terminal. The capacitive energy storage means comprises two individual capacitors a first of which is in circuit between the tap and a common electrical point and the second of which is in circuit between the one output terminal and the aforementioned common electrical point. A charging resistor means is connected between the common electrical point and the other output terminal. The aforementioned blocking diode means comprises a first blocking diode having its anode connected to the common electrical point and its cathode connected in circuit with the aforementioned tap. A gate-controlled solid-state switching means comprises an SCR, the anode of which is connected intermediate the aforementioned first capacitor and the first blocking diode and the cathode of the SCR is connected in circuit with the common electrical point. A Zener diode means comprises a Zener diode, a bleeder resistor means, and associated second blocking diode means. The Zener diode has a predetermined Zener voltage which is greater than the operating voltage for the lamp, but less than the peak voltage of the AC source. The Zener diode and the second blocking diode means are connected in series. The bleeder resistor means is connected in circuit between the gate and cathode of the SCR. The cathode of the Zener diode is connected in circuit with the second winding portion of the ballast inductor. The anode of the Zener diode is connected in circuit with the gate of the SCR. The second blocking diode means is connected with its anode in circuit with the second winding portion of the ballast inductor and its cathode in circuit with the gate of the SCR. In the operation of the foregoing apparatus, when it is initially energized, both the first and second capacitors are charged through the charging resistor and when the second capacitor charges to a voltage which exceeds the Zener voltage of the Zener diode, the SCR is gated which causes both the first and second capacitors to discharge through the second winding portion to cause the autotransformer action thereof to apply a voltage pulse of sufficient magnitude across the output terminals to start the lamp connected thereacross. After the lamp is started, the Zener voltage of the Zener diode is not exceeded, thereby rendering the lamp starting portion of the apparatus inoperative. In another embodiment, the blocking diode means includes a third blocking diode with its cathode connected to the common electrical point and its anode connected to the cathode of the SCR which permits a larger charging resistor to be used thereby diverting less power of the starting pulses from the lamp load.

BRIEF DESCRIPTION OF THE DRAWINGS

For a better understanding of the invention, reference may be had to the preferred embodiment, exemplary of the invention, shown in the accompanying drawings in which.

DESCRIPTION OF THE PREFERRED EMBODIMENTS

Figure 1:
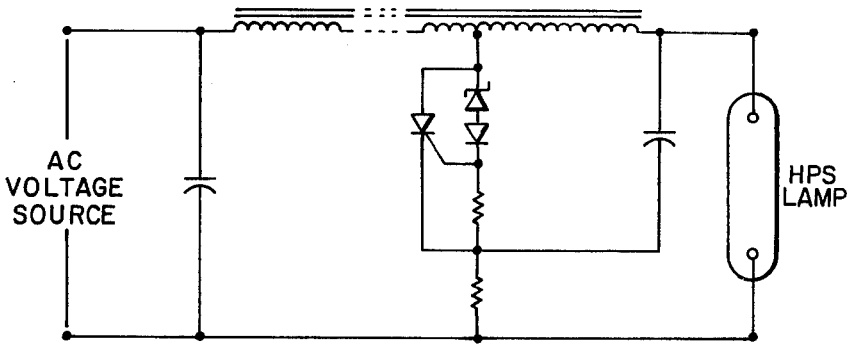
FIG. 1 PRIOR ART
FIG. 1 is a circuit diagram of a representative prior art starting circuit which is shown for purposes of comparison.

A prior art circuit as shown in FIG. 1 is representative of the circuit as generally described in the aforementioned copending application Ser. No. 540,195, filed Jan. 10, 1975. This starting and operating circuit for a high-pressure sodium discharge lamp uses a Zener diode to provide accurately timed starting pulses and this Zener diode senses the voltage developed across the paralleling capacitor to accurately time its breakdown which in turn triggers the SCR, with the resulting autotransformer action generating a high voltage starting pulse across the lamp. As indicated hereinbefore, with ballast reactors of low open circuit voltages, such as 110 volts, difficulties are encountered in starting the lamp in that the stored energy in the paralleling capacitor may be insufficient to develop a satisfactory starting pulse by autotransformer action. These difficulties are overcome by the circuit of the present invention, without resort to the use of supplemental R.F. chokes.

Figure 2:
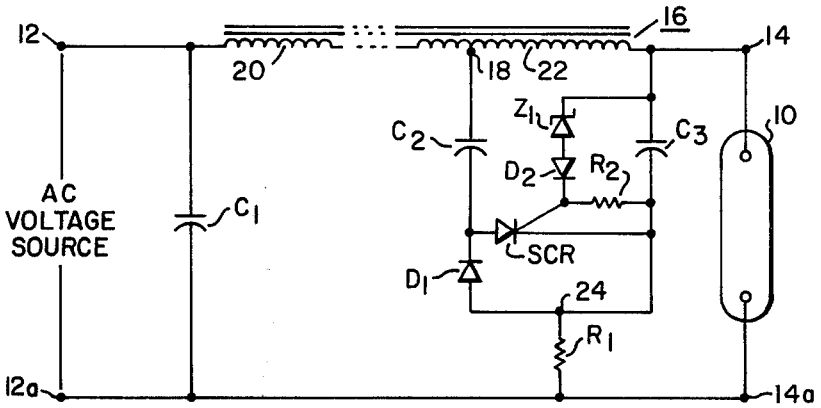
FIG. 2 is a circuit diagram of a preferred embodiment of the present invention which utilizes only oneblocking diode in the energy storage circuit.

One preferred embodiment of the present invention is shown in FIG. 2 which comprises a starting and operating apparatus for connection across an AC source for starting and then operating a high-pressure sodium discharge lamp 10. The apparatus comprises input terminals 12 and 12*a* adapted (i.e., operable) to be connected across the AC source and output terminals 14 and 14*a* adapted (i.e., operable) to have the discharge lamp 10 connected thereacross. When the AC source has a high impedance, a power factor correcting capacitor $C_1$ is connected across the input terminals 12, 12*a* and this power factor correcting capacitor also provides high frequency bypass in order to provide a path for the pulse to bypass the AC source. The capacitor $C_1$ is unnecessary when the AC source has a low impedance.

A ballast inductor 16 having a tap 18 intermediate the ends thereof defines a first winding portion 20 and a second winding portion 22, the first winding portion 20 having a greater length than the second winding portion 22, with the first and second winding portions having a transformation ratio therebetween substantially greater than unity. In the specific example as given, the first winding 20 has 248 turns and the second winding 22 has 12 turns. The ballast inductor 16 is connected at its ends in series between one of the input terminals 12 and one of the output terminals 14 with the second winding portion 22 connected to the output terminal 14. The other of the input terminals 12*a* electrically connects to the other of the output terminals 14*a*.

A capacitive energy storage means and blocking diode means therefor is connected across the second winding portion 22 of the ballast inductor 16 and is in circuit with the other output terminal 14*a*. The capacitive energy storage means comprises two individual capacitors a first, $C_2$, which is in circuit between the tap 18 and a common electrical point 24 and a second capacitor $C_3$ which is in circuit between the output terminal 14 and the common electrical point 24. A charging resistor means $R_1$ connects between the common electrical point 24 and the other output terminal 14*a*. The aforementioned blocking diode means comprising a first blocking diode $D_1$ has its anode connected to the common electrical point 24 and its cathode connected in circuit with the tap 18.

A gate-controlled solid-state switching means comprises an SCR, the anode of which is connected intermediate the first capacitor $C_2$ and the first blocking diode $D_1$, and the cathode of the SCR is connected in circuit with the common electrical point 24.

A Zener diode means comprising a Zener diode $Z_1$ has a predetermined Zener voltage, 120 volts being preferred, which is greater than the operating voltage of the lamp for reasons as explained hereinafter and less than the peak voltage of the AC source. The Zener diode circuit comprises the Zener diode $Z_1$, a second blocking diode means $D_2$ and a bleeder resistor means $R_2$. The Zener diode and the second blocking diode means $D_2$ are connected in series. The bleeder resistor means $R_2$ is connected in circuit between the gate and the cathode of the SCR. The cathode of the Zener diode $Z_1$ is connected in circuit with the second winding portion 22 and the anode of the Zener diode $Z_1$ is connected in circuit with the gate of the SCR. The bleeder resistor $R_2$ serves to prevent premature gating of the SCR.

In the operation of the foregoing apparatus, when it is initially energized, capacitor $C_2$ is charged on the negative half cycle and capacitor $C_3$ is charged on both positive and negative half cycles through the charging resistor $R_1$. When the second capacitor $C_3$ charges to a voltage which exceeds the Zener voltage of the Zener diode $Z_1$, the SCR is gated which causes both the first and second capacitors, $C_1$ and $C_2$, to discharge in an additive manner through the second winding portion 22 to cause the autotransformer action thereof to apply a voltage pulse of sufficient magnitude, such as 3000 volts, across the output terminals 14, 14*a* to start the lamp 10 connected thereacross. After the lamp is started, the Zener voltage of the Zener diode $Z_1$ is not exceeded which renders the lamp starting portion of the apparatus inoperative. Since the charging resistor $R_1$ has a relatively high value, little pulse power will be lost. The foregoing circuit provides optimum control of the firing of the lamp because the charge on $C_3$ reverses every half cycle.

Figure 3:
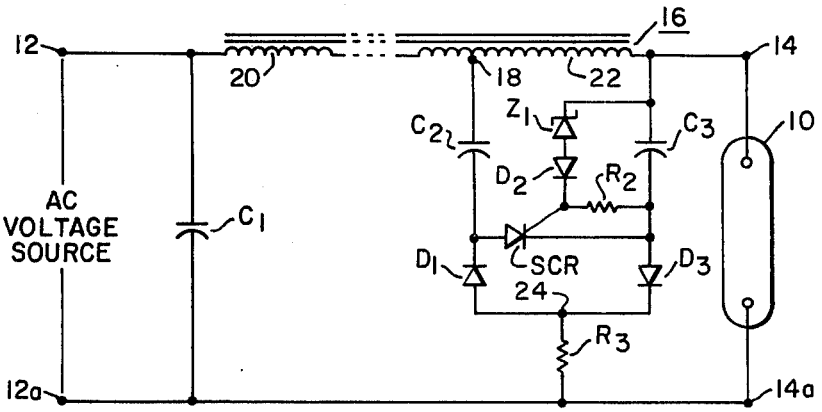
FIG. 3 is a circuit diagram of another embodiment wherein two blocking diodes are used in the energy storage circuit.

FIG. 3 is a circuit diagram of an alternative preferred embodiment wherein said blocking diode means includes a third blocking diode $D_3$ is included in the circuit with its cathode connected to the common electrical point 24 and its anode connected to the cathode of the SCR. The third blocking diode $D_3$ allows the capacitor $C_3$ to charge only on the positive half cycle and in this embodiment, a larger charging resistor $R_3$ may be used than was used in the circuit embodiment shown in FIG. 2. The circuit embodiment shown in FIG. 2 normally controls the firing timing more accurately, however, because of less variation in residual charge from the preceding cycle. Following is a table setting forth the component values for the foregoing circuits:

TABLE I

| (Values common to both FIGS. 2 and 3) | |
|---|---|
| $C_1$ | 55 MFD, 400 VDC |
| $C_2$ | 0.33 MFD, 400 VDC |
| $C_3$ | 0.15 MFD, 400 VDC |
| $D_1$, $D_2$ | 1N 4005 |
| $Z_1$ | 1N 987B, 120V, 400 mw |
| SCR | ECC S4003LS2 |
| Lamp 10 | 55 Volt, 150 Watt, High Pressure Sodium |
| $R_2$ | 1 K, ½ Watt |

TABLE II

| (Specific to apparatus of FIG. 2) | |
|---|---|
| $R_1$ | 10 K, 10 Watt |

TABLE III

| (Specific to apparatus of FIG. 3) | |
|---|---|
| $R_3$ | 18 K, 5 Watt |
| $D_3$ | 1N 4007 (6 in series) or one 3500V |

TABLE III-continued

| (Specific to apparatus of FIG. 3) |
|---|
| diode |

I claim as my invention:

1. A starting and operating apparatus for connection across an AC source for starting and then operating a high-pressure sodium discharge lamp, said apparatus comprising:

(a) input terminals operable to be connected across said AC source, output terminals operable to have said discharge lamp connected thereacross, a ballast inductor having a tap intermediate the ends thereof to define first and second winding portions, said first winding portion having a greater length than said second winding portion and having a transformation ratio therebetween substantially greater than unity, said ballast inductor connected at its ends in series between one of said input terminals and one of said output terminals with said second winding portion connecting to said one output terminal, and the other of said input terminals electrically connected to the other of said output terminals;

(b) capacitive energy storage means and blocking diode means therefor connected across said second winding portion of said ballast inductor, and also in circuit with said other output terminal, said capacitive energy storage means comprising two individual capacitors a first of which is in circuit between said tap and a common electrical point and the second of which is in circuit between said one output terminal and said common electrical point, a charging resistor means connected between said common electrical point and said other output terminal, and said blocking diode means comprising a first blocking diode having its anode connected to said common electrical point and having its cathode connected in circuit with said tap;

(c) gate-controlled solid-state switching means comprising an SCR the anode of which is connected intermediate said first capacitor and said first blocking diode, and the cathode of said SCR is connected in circuit with said common electrical point;

(d) Zener diode means comprising a Zener diode, a bleeder resistor means, and a second blocking diode means, said Zener diode having a predetermined Zener voltage which is greater than the operating voltage for said lamp, but less than the peak voltage of said AC source, said Zener diode and said second blocking diode means connected in series, said bleeder resistor means connected in circuit between the gate and cathode of said SCR, the cathode of said Zener diode connected in circuit with said second winding portion and the anode of said Zener diode connected in circuit with the gate of said SCR, and said second blocking diode means is connected with its anode in circuit with said second winding portion and its cathode in circuit with the gate of said SCR; whereby when said apparatus is initially energized, both said first and second capacitors are charged through said charging resistor means, and when said second capacitor charges to a voltage which exceeds said Zener voltage of said Zener diode said SCR is gated thereby causing both said first and second capacitors to discharge through said second winding portion to cause the autotransformer action thereof to apply a voltage pulse of sufficient magnitude across said output terminals to start said lamp connected thereacross, and after said lamp is started, the Zener voltage of said Zener diode is not exceeded, thereby rendering the lamp starting portion of said apparatus inoperative.

2. The starting and operating apparatus as specified in claim 1, wherein said blocking diode means includes a third blocking diode with its cathode connected to said common electrical point and its anode connected to the cathode of said SCR.

3. The starting and operating apparatus as specified in claim 1, further comprising a power factor correcting capacitor, which also provides high frequency bypass connected across said input terminals.

* * * * *